United States Patent [19]

Boyd

[11] Patent Number: 4,811,872

[45] Date of Patent: Mar. 14, 1989

[54] SECURABLE BEVERAGE DISPENSING SERVER

[75] Inventor: David D. Boyd, Portland, Oreg.

[73] Assignee: Boyd Coffee Company, Portland, Oreg.

[21] Appl. No.: 85,340

[22] Filed: Aug. 14, 1987

[51] Int. Cl.[4] ..... B67D 5/56

[52] U.S. Cl. ..... 222/610; 141/86; 222/136; 222/129.1; 222/108; 222/628; 312/118; 312/126

[58] Field of Search ..... 141/86, 88; 222/173, 222/610, 628, 108, 130, 129.1, 131, 136; 312/118, 236, 126

[56] References Cited

U.S. PATENT DOCUMENTS

| | | | |
|---|---|---|---|
| 953,648 | 3/1910 | Tyson | 222/131 |
| 1,896,382 | 2/1933 | White | 222/136 |
| 2,080,923 | 5/1937 | Lassen | 222/131 |
| 2,090,665 | 8/1937 | Carter | 222/173 X |
| 2,461197 | 2/1949 | Chambers | 222/628 |
| 2,750,076 | 6/1956 | Welty et al. | 222/129.1 |
| 3,130,873 | 4/1964 | Klutz, Jr. | 222/131 |
| 3,139,219 | 6/1964 | Gran | 222/131 |
| 3,142,415 | 7/1984 | Louchheim | 221/96 |
| 3,331,533 | 7/1967 | Krugger | 221/96 |
| 3,604,592 | 9/1972 | Bacon | 221/96 |
| 3,949,902 | 4/1976 | Thompson | 222/129.1 |
| 4,076,349 | 2/1978 | Gettleman et al. | 312/236 |
| 4,171,171 | 10/1979 | Jones | 401/150 |
| 4,217,013 | 8/1980 | Herrington et al. | 312/322 |
| 4,304,341 | 12/1981 | Shirley | 222/131 |
| 4,541,526 | 9/1985 | Berg et al. | 206/44.12 |
| 4,674,656 | 6/1987 | Wiley et al. | 222/129.1 |

*Primary Examiner*—Harvey C. Hornsby
*Assistant Examiner*—Christine A. Peterson
*Attorney, Agent, or Firm*—Kolisch, Hartwell & Dickinson

[57] ABSTRACT

The beverage and condiment dispensing server is disclosed. The server consists of a support framework having a base, a cup supporting surface and sidewalls extending generally vertically therebetween. The double-wide server's base is dimensioned to receive thereon two, laterally positioned, frusto-conically tapered beverage containers, each having a manually operable spigot near its top for dispensing a beverage into a cup, and further being dimensioned to receive two, laterally positioned, removable trays for receiving and organizing condiments and the like. The sidewalls of the framework form a through opening extending from the front of the framework to the rear of the framework, providing access to the condiment trays to remove their contents and to remove and install the trays themselves, and providing a rear access for installing and removing the containers. The rear edge of the elevated, cup supporting surface is contoured to semi-circumferentially engage a tapered portion of each container installed on the base, which edge cooperates with a slidably securable lock plate extending between upper, rear edges of the side walls generally diametrically opposite the contoured edge, to securely capture the containers therebetween. The elevated cup supporting surface is equipped with absorbent, spillover containing trays at each container position. In a proposed modification, a key lockably securable single-wide beverage and condiment dispensing server is disclosed.

4 Claims, 4 Drawing Sheets

SECURABLE BEVERAGE DISPENSING SERVER

BACKGROUND AND SUMMARY OF THE INVENTION

This invention relates generally to beverage dispensing servers. More particularly, the invention concerns a server usable with a portable dispensing container, which may be lockably secured within the server The airpot-type beverage container provides convenient, portable, manually operable hot or cold beverage dispensing capability. It permits a hot beverage, such as coffee, to be brewed in advance of, and remote from, the time and place it is served, while keeping the coffee hot and fresh The container's size and shape make it possible for the container to be positioned on a tabletop for dispensing of beverages. Reliable, drip-free beverage dispensing from a spigot associated with the lid is achievable by holding a cup directly beneath the spigot Because of the height of the greater capacity airpot-type container, dispensing a beverage therefrom is typically a two-handed operation the user must pump with one hand and hold the cup at an elevated level above the tabletop and underneath the spigot with the other. If condiments, e.g. sugar and cream, or implements, e.g. stirrers, are to be served with the beverage, they must be provided at a nearby location that is separate from the otherwise self-contained, airpot-type beverage dispenser.

To provide the full service dispensing of beverages, the airpot-type container must be augmented with an arrangement of condiments and implements on, for example, the tabletop next to the container. Besides having a makeshift appearance, such an arrangement invites disorganization and the accumulation of unsightly litter By the end of the function being catered, disarray usually has spread across the entire surface of the tabletop, ultimately discouraging and inconveniencing the user.

Accordingly, is an object of this invention to provide a compact, full service beverage and condiment dispensing server usable with portable, airpot-type dispensing beverage containers Another object is to provide a server with an elevated cup supporting surface that enables one-handed operation of the manually operable spigot of such a container for the dispensing of a beverage therefrom.

A further object is to provide a server that easily may be maintained.

Yet another object of the invention is to provide a server that permits the lockable securing therein of one or more such containers.

Still another object of the invention is to provide a server within, and from which, the containers easily may be installed and removed Further, it is an object of the present invention to provide a server that permits easy access to condiments and the like that may be organized therein Accordingly, the present invention proposes a server, or stand, for use with one or more portable beverage containers with condiments and the like, providing lockable security of the containers within the server in a compact, well-organized and easily maintained structure. A support framework is provided that includes means for receiving and supporting at least one container in such manner that the spigot associated therewith is accessible for manual operation, the receiving-supporting means including a base, the framework further including means for supporting a cup at an elevated level relative to the base and positioned to receive the beverage while it is dispensed. Means are provided for separably securing together each container and the framework.

In the preferred embodiment of the invention, the cup supporting means takes the form of an elevated, flat, level panel supported on either side by side walls extending vertically from the base. The base, panel and sidewalls bound a through opening extending from the front to the rear of the framework. The cup supporting surface is equipped with twin, absorbent, spillover containing trays, each located beneath the spigot of a container when the container is received on the base. The surface has a contoured rear edge conforming semicircumferentially to the tapered portions of two laterally positioned, frusto-conically shaped containers.

The containers are each key lockably securable within the server by slidably positionable lock plate that extends between the rear edge of the sidewalls. The plate may be positioned against the containers and generally diametrically opposed to the contoured edge of the cup supporting panel. The base is further dimensioned to receive thereon two laterally positionable, segmented trays for receiving and organizing therein condiments and the like. The framework and the plate are formed from sheet metal of stainless steel, thereby providing smooth, easily maintained interior and exterior surfaces in a durable, lightweight, full service stand.

In a modification to the preferred embodiment, a single-wide server is provided having the same novel features and yielding the advantages described above, but having instead a base dimensioned to receive only one container and only one tray for condiments and the like.

DETAILED DESCRIPTION OF THE PREFERRED EMBODIMENT

Figure 1:
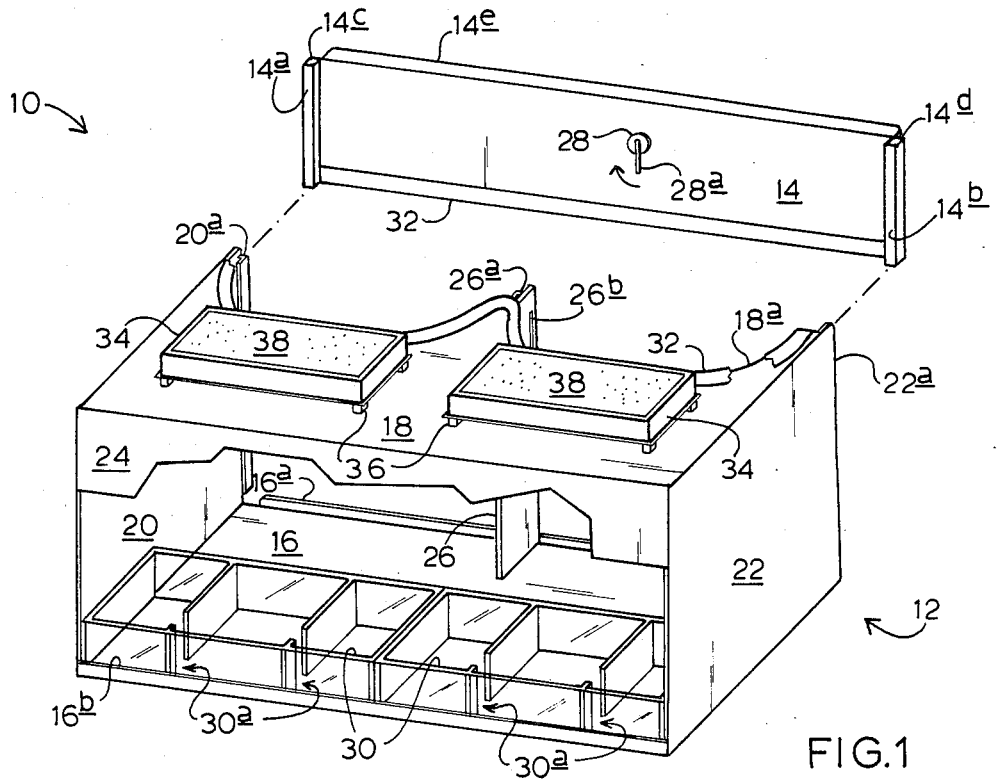
FIG. 1 is a front, isometric view of double-wide, beverage and condiment dispensing server components made in accordance with the invention.

FIG. 1 is a front, isometric view of a double-wide server, indicated generally at 10, made in accordance with the present invention. Server 10 comprises a hollow housing or support framework 12 and securing means, or lock plate 14, for separably securing together at least one airpot-type container and server 10. Framework 12 includes receiving-supporting means having a base 16 dimensioned to receive thereon two beverage containers (not shown in FIG. 1, but shown in FIGS. 3 and 4) such that the manually operable spigot near the top of the containers is accessible when the containers are received on, and supported by, base 16. Framework 12 also includes means for supporting a cup, i.e. panel 18, at an elevated position relative to the base and at a height below the level of each spigot when the containers are received in framework 12. The rear edge of panel 18 is contoured and dimensioned, matingly and semi-circumferentially, to engage a tapered portion of the outer surface of each container when received on base 16, in a manner that will be described in reference to FIG. 3.

Panel 18 is supported above base 16 by left and right sidewalls 20, 22 at a height, in the preferred embodiment, of approximately half that of the containers. Also in the preferred embodiment, a front skirt 24 extends across, and part way down the front opening formed by base 16, panel 18 and sidewalls 20, 22. A vertical support 26 having a rear, hooked, or U-shaped, slightly forwardly inclined edge 26*a*, support 26 being positioned halfway between sidewalls 20, 22 and extending vertically from base 16 to panel 18, provides additional support for surface 18 and provides for the securing of lock plate 14 to framework 12.

Figure 2:
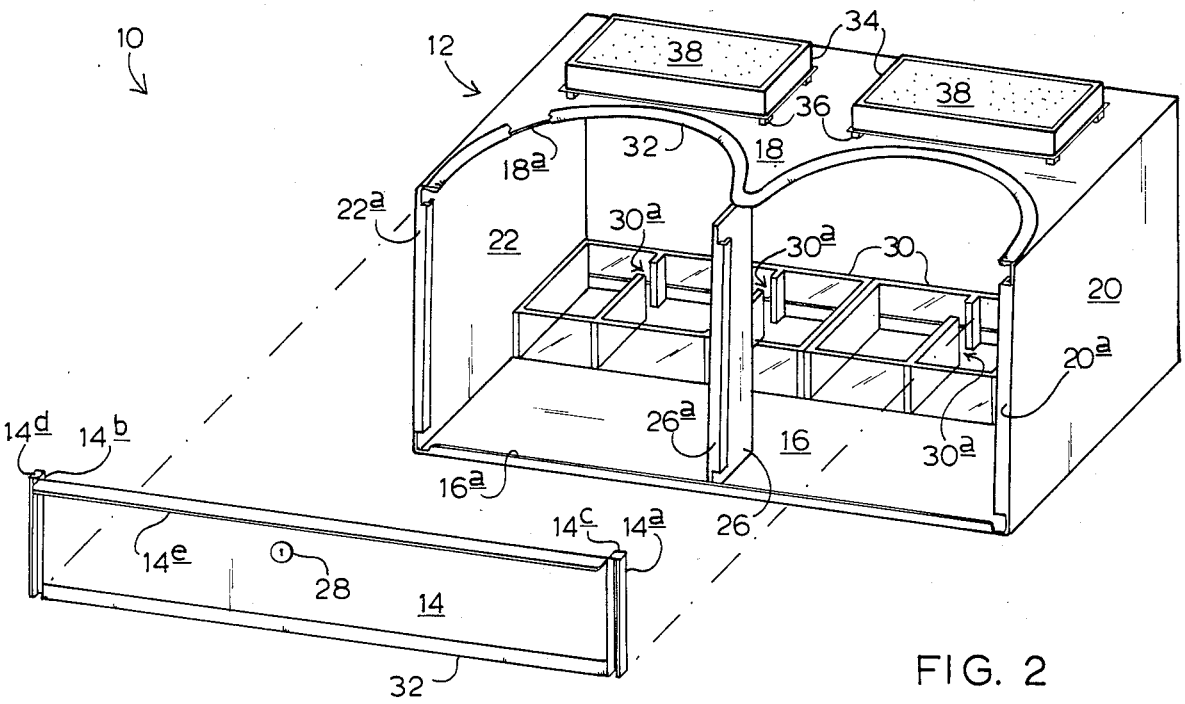
FIG. 2 is a rear, isometric view corresponding to FIG. 1.

Lock plate 14 provides a way of conveniently securing one or more containers within the perimeter of framework 12 by extending in a straight line across the rear of framework 12, and by slidably engaging the rear, hooked, or U-shaped, slightly forwardly inclined edges 20*a*, 22*a* of sidewalls 20, 22 by mating, U-shaped edges 14*a*, 14*b* of plate 14. Tabs 14*c*, 14*d*, which close the upper ends of U-shaped edges 14*a*, 14*b*, respectively, provide stops beyond which plate 14 cannot slide as it is installed on framework 12, and right-angle, lengthwise lip 14*e* provides reinforcement of plate 14 against bowing The dash-dot lines in FIGS. 1 and 2 show the way in which plate 14 may be elevated to the level of panel 18; U-shaped edges 14*a*, 20*a*, and 14*b*, 22*a* may be aligned to capturedly engage each other; and plate 14 may be slid onto sidewalls 20, 22 until stops 14*c*, 14*d* are reached. A conventional, key operable, radial arm lock 28 is provided to the right of center of plate 14 (as viewed from the front of server 10, as in FIG. 1) and may be pivoted counterclockwise relative to the rear of server 10, or in the direction shown by the arrow, to position radial arm 28*a* through slot 26*b* of support 26.

In the preferred embodiment, plate 14; base 16; panel 18; sidewalls 20, 22; skirt 24; and support 26 are of thermally non-insulating material, preferably formed from sheet metal of 0.127 cm thick (18# U.S. standard gauge) stainless steel. The use of stainless steel provides a smooth finish that is scratch- and stain-resistant and, therefore, easily may be maintained. The through opening extending from the front to the rear of framework 12 advantageously provides front access to the two removable condiment trays 30, and provides rear access to the beverage containers. The through opening also provides substantially uninterrupted surfaces extending along the interior of framework 12 to facilitate cleaning. Preferably, exposed sheet metal edges are rolled in order to present a safe, smooth, finished quality to server 10.

A nonabrasive, ductile material 32 such as vinyl extends along, securely gripping, the contoured, rear edge 18*a* of panel 18, as well as along the straight, lower edge of lock plate 14. Material 32 protects the beverage containers from being scratched or abraded by the edges of plate 14 and surface 18.

Segmented trays 30, which extend laterally and substantially the width of base 16, easily may be placed, one at a time, on base 16 just behind a retaining lip 16*b*. In the preferred embodiment, trays 30 are made of transparent, 0.3175 cm (0.125 inch) thick polycarbonate, and a section 30*a* of each of two dividers within each tray 30 is removed to permit implements, e.g. stirrers, easily to be grasped by the user, when stored in the central compartment of tray 30. It will be appreciated that condiments may include sugar, creamer, or even tea bags for use with containers of hot water Referring still to FIGS. 1 and 2, panel 18 mounts spillover containing means, or spillover trays 34, located directly beneath the spigots of the containers when installed, in order to catch spillover of beverage from a cup (not shown) when the beverage is dispensed thereinto. Standoffs, or mounts, 36 are provided in the preferred embodiment, and may secure trays 34 to panel 18 as, for example, by loop and pile patches located on each of four corners. Finally, trays 34 contain a stiff, absorbent material 38 that is capable of providing support to a cup as a beverage is dispensed thereinto, and to draw liquid that may be spilled over from the cup and onto surface 38 away from the bottom of the cup. Spongy, foam materials such as those used in furnace air filters have been found to provide the needed support and absorbency.

Figure 3:
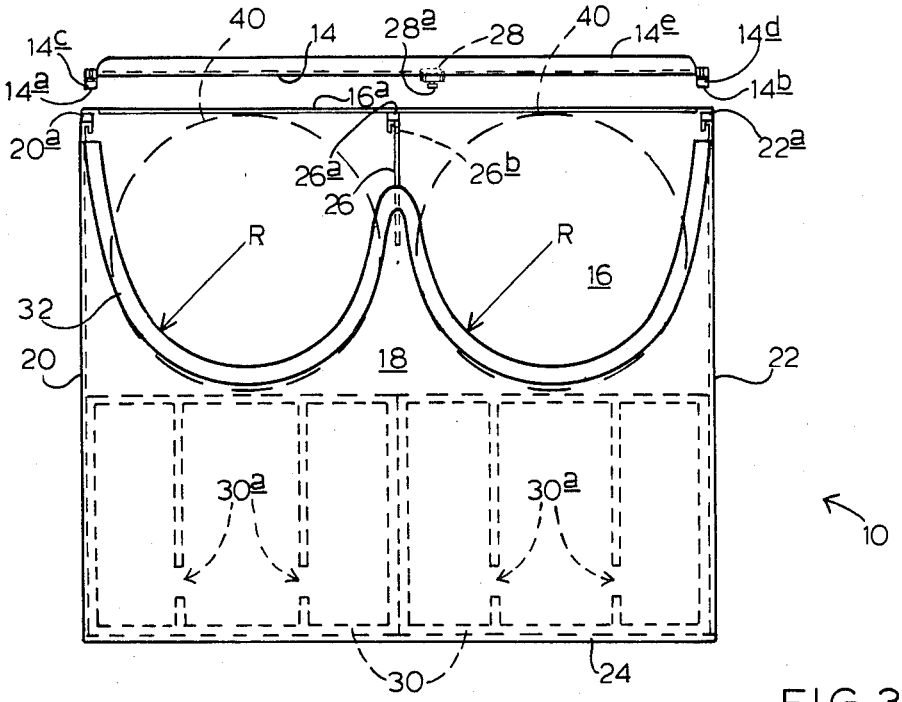
FIG. 3 is a top view of the double-wide server components, outlining the layout of the base.
Figure 4:
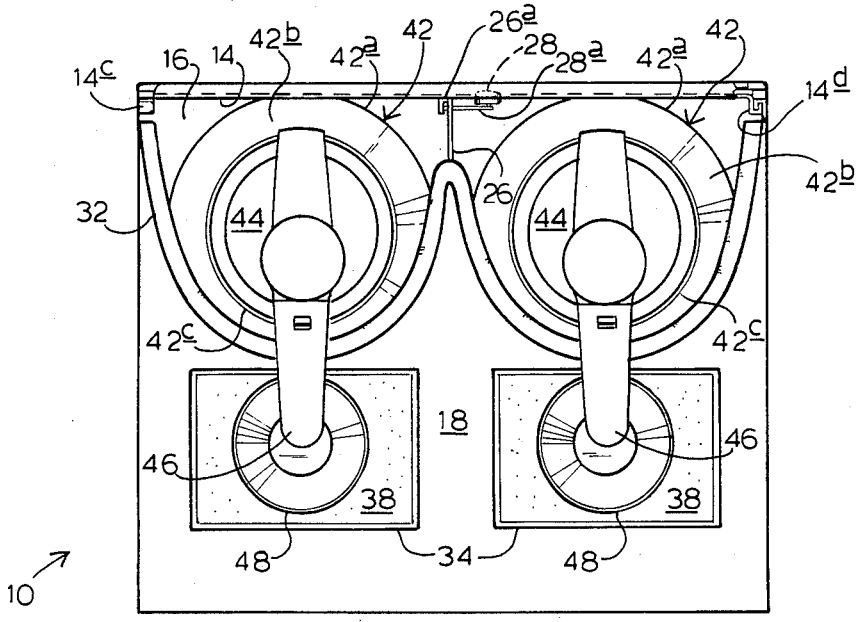
FIG. 4 is a top view similar to FIG. 3, except it shows spillover containing trays, twin airpot-type beverage containers and the lock plate in a fully assembled, double-wide server.

Referring collectively now to FIGS. 3 and 4, both top views of server 10, the general layout of base 16 and panel 18 will be described in detail. Two side-by-side dashed circles 40 describe the outline on base 16, and against rear lip 16*a*, of the wider bottom of beverage container 42, shown installed on base 16 in FIG. 4. It will be understood that the semi-circumferential extent of contoured edge 18*a* of surface 18 is of a radius R, dimensioned approximately to equal the radius of frusto-conical containers 42 at the height thereon of surface 18 above base 16.

In this way, when containers 42 properly are received on base 16 as shown in FIG. 4, material 32 extending semi-circumferentially along rear edge 18*a* matingly engages containers 42 in a semicircular arc. When lock plate 14 is installed in contact with the outer surface of each container at a location generally diametrically opposed to the contoured rear edge 18*a* of cup supporting panel 18, as described in reference to FIGS. 1 and 2, and as illustrated in FIG. 4, containers 42 are securely captured between plate 14 and rear edge 18*a*, providing lateral support for, and lockable security against theft of, containers 42. FIG. 4 shows radial arm 28*a* of lock 28 extending through slot 26*b* of vertical support 26 and shows, in cutaway view of the right side of server 10, the slidable engagement between U-shaped edges 14*d*, 22*a* which restricts movement between plate 14 and framework 12 to sliding movement along an axis parallel to their edges. In the preferred embodiment, rear edges 20*a*, 22*a*, 26*a* lie in a plane that is slightly forwardly inclined from the vertical and that intersects frusto-conically tapered region 42*b* of a container, such as container 42, in a straight line It will be understood that, in the interest of clarity, the typically U-shaped, pivotable handles of manually portable containers 42 have been omitted from the various illustrations included herein.

Referring still to FIG. 4, tapered region 42*b* extends along containers 42 from their larger diameter bottoms 42*a* to their smaller diameter tops 42*c*. Adjacent top 42*c* of container 42 is a lid 44 having a manually operable spigot 46 preferably locatable directly above the center of spillover trays 34. By this location and orientation of beverage containers 42, beverage therefrom single-handedly may be dispensed into cups 48. If a user accidentally tips or overfills cup 48, the spillover will be contained by tray 34 and will be absorbed by absorbent material 38.

Figure 5:
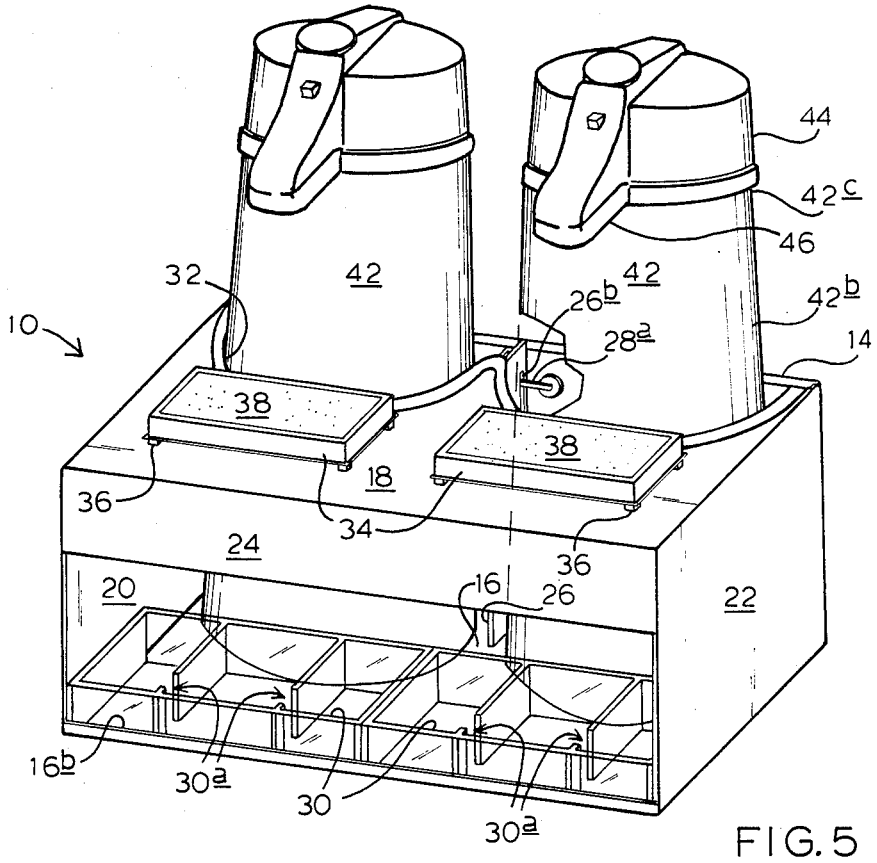
FIG. 5 is a front, isometric view corresponding to FIG. 4.

Turning next to FIG. 5, a front, isometric view of server 10, with containers 42 securely installed, is shown. It may be seen that containers 42 extend well above cup supporting panel 18, which is, in the preferred embodiment, located at a height intermediate base 16 and spigots 46 of containers 42. It will be appreciated that these dimensions are not critical, and that, within the spirit of the invention, any desirable height of panel 18 intermediate condiment trays 32 and spigots 46 may be chosen. Particular dimensions notwithstanding, it will be appreciated that the novel arrangement, organization and structure of server 10 provide a compact, space saving, well-organized, full service, beverage and condiment dispensing server.

Figure 6:
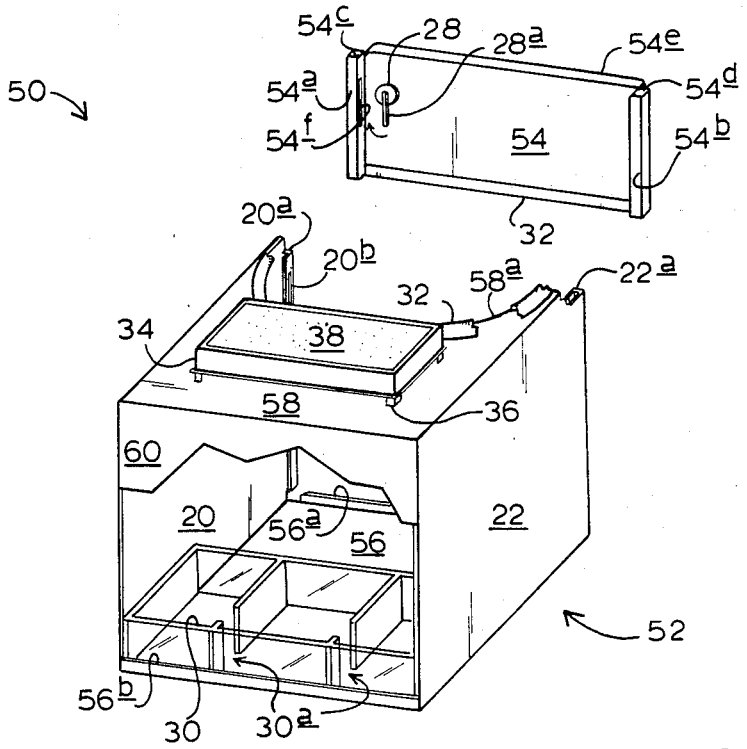
FIG. 6 is a front, isometric view of a modification to the preferred embodiment, wherein single-wide, beverage and condiment dispensing server components are shown.

Turning now to FIG. 6, a modification to the preferred embodiment of the invention is shown. It will be understood that where components are referenced in the modification that correspond to identical components illustrated in the preferred embodiment (described in reference to FIGS. 1 through 5), they are designated identically. A single-wide server 50 includes a framework 52 and a lock plate 54. Framework 52 is identical to framework 12, except it includes a single-wide base 56; rear and front lips 56*a*, 56*b*; a single-wide cup supporting surface 58 having a single, generally circularly contoured rear edge 58*a*; and a single-wide front skirt 60. Left, U-shaped edge 20*a* has a slotted hole 20*b* formed therein, as shown, for receiving radial arm 28*a* of lock 28 therethrough. It will be understood that a lock plate 54 is provided that is identical to lock plate 14, except that plate 54 has a slotted through hole 54*f* in the side of a U-shaped edge 54*a*.

Figure 7:
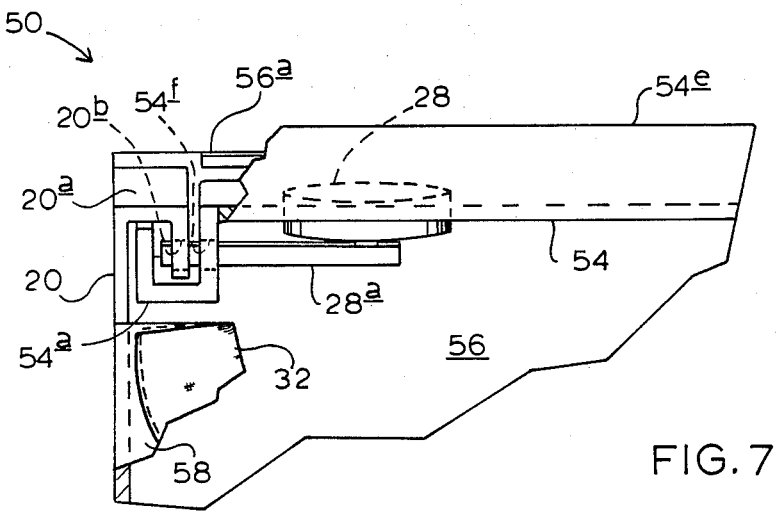
FIG. 7 is an enlarged fragmentary, top view corresponding to FIG. 6, detailing the slidably capturable lock plate assembly of the single-wide server.

Turning finally to FIG. 7, an enlarged, fragmentary detail of the left, rear corner of server 50 is shown (with a left tab 54*c* cut away). Radial arm 28*a* is shown in its pivoted, locked position, extending first through slotted hole 54*f* in plate 54 and second through slotted hole 20*b* in the side of U-shaped edge 20*a*. It will be appreciated that, by the combination of restricted, sliding movement between plate 54 and sidewall 20 along an axis parallel to edges 20*a*, 54*a*, and the restriction against sliding therealong imposed by the extension through slotted holes 54*f* and 20*b* of radial arm 28*a*, framework 52 and plate 54 are separably secured together to form server 50.

Obviously, it is within the spirit of the invention to dimension double-wide server 10 and single-wide server 50 to accommodate any desired size of beverage container. It also will be appreciated that more than two such beverage containers may be accommodated merely by extending the width of certain framework components and by forming third and further semicircular contours along the rear edge of cup supporting panel 18. Finally, it will be appreciated that condiment trays 32 may be formed, for example, integrally with base 16, although the advantage of easy removal of trays 32 from base 16, e.g., to wash in a dishwasher, will be lost.

Accordingly, while a preferred embodiment of the invention and a modification thereto have been described, it is appreciated that further modifications are possible that come within the scope of the invention.

It is claimed and desired to secure by letters patent:

1. A stand for holding at least one beverage container, the container having a bottom and a top of smaller diameter than the bottom, the top having a manually operable spigot for dispensing beverage contained within the container into a cup, the stand comprising:
   - a hollow housing including a base and sides extending upwardly from the base,
   - the base having a size sufficient to receive the bottom of the container,
   - a panel elevated from the base fastened to and supported on the sides of the housing,
   - said panel having a contoured rear edge configured snugly to engage a side of the container in a region of the container between the top and bottom which has a diameter intermediate the diameter of the top and bottom,
   - said housing having a rear access opening providing access to the interior of the housing to permit placement of the container with the bottom of the container on said base and a side thereof against said contoured rear edge, and
   - a detachable plate detachable fastened to said housing for at least partially closing said access opening, said plate when fastened to the housing having an expanse opposite said contoured edge and said edge and said expanse bounding opposite sides of a space located therebetween which receives said region of the container, the side-to-side dimension of said space being less than the diameter of the container bottom thus to inhibit withdrawal of the container through said space.

2. The stand of claim 1 wherein the base is dimensioned further to receive thereon at least one tray for condiments and the like, and wherein the housing further includes a front opening providing access to the base, the front opening being dimensioned to permit the placement on and removal from the base of at least one tray from condiments and the like.

3. The stand of claim 2, wherein said panel has an expanse positioned under the spigot of the container adapted to support a cup and spillover containing means is mounted on said expanse, and said spillover containing means is absorbent.

4. The stand of claim 2 wherein the rear access opening and the front opening meet to form a single through opening extending from the front of the housing to the rear of the housing, the through opening being bounded on either side by said sides.

* * * * *